United States Patent [19]

Green

[11] 4,362,044

[45] Dec. 7, 1982

[54] PIPE-BENDING DIE AND METHOD

[75] Inventor: Arthur A. Green, Scarsdale, N.Y.

[73] Assignee: Tubeco, Inc., Brooklyn, N.Y.

[21] Appl. No.: 196,300

[22] Filed: Oct. 14, 1980

[51] Int. Cl.[3] ..... B21D 7/00

[52] U.S. Cl. ..... 72/388; 72/292

[58] Field of Search ..... 72/292, 388, 387, 459, 72/367, 149, 322

[56] References Cited

U.S. PATENT DOCUMENTS

| | | | |
|---|---|---|---|
| 2,771,116 | 11/1965 | Ballard | 72/322 |
| 3,456,468 | 7/1969 | Crippen | 72/388 |
| 3,943,747 | 3/1976 | Wesler | 72/388 |
| 4,269,056 | 5/1981 | Kozinski | 72/459 |

*Primary Examiner*—Gene Crosby

*Attorney, Agent, or Firm*—Hopgood, Calimafde, Kalil, Blaustein & Judlowe

[57] ABSTRACT

The invention contemplates a pipe-bending technique wherein an arcuate die which determines the course of bending the central axis of the pipe relies solely upon two tangentially engaging developing lines of contact which are spaced equally, at opposite offsets from the radial plane in which the pipe axis is bent. For the case of pipe bending to a circular arc, the opposed die faces are generally conical, and there is no pipe contact with the die in the range between the spaced developing lines of tangential contact.

9 Claims, 5 Drawing Figures

PIPE-BENDING DIE AND METHOD

BACKGROUND OF THE INVENTION

The invention relates to the bending of metal pipe, as for example to the bending of steel pipe.

A current practice in the hot-bending of large-diameter steel pipe, e.g., 4-inch diameter and up to 42-inch diameter, is to fill a straight pipe length with sand, subjecting the filled pipe to heat-soaking at an elevated temperature, supporting the heat-soaked length with one end clamped to and end of an arcuate forming die, and applying bending force to the free end of the pipe to the extent of a prescribed angle of bent wrap around the die, the die having a sectional radius of concave curvature which equals or is slightly greater than the outside curvature (O.D.) of the pipe. Such a process and bending die are described in Crippen, U.S. Pat. No. 3,456,468.

Generally speaking, it has been considered that five pipe diameters is the minimum curvature radius to which such pipe can be acceptably bent, i.e., without causing the cross-section of the pipe to change from circular to generally elliptical, and without causing local corrugations to develop in the concave side of the bend. The Pipe Fabrication Institute has expressed this limitation at paragraph 4.1 of its PFI Standard ES-24 (April 1975), stating:

"When the radius of a bend is 5 nominal pipe diameters or greater, and the ratio of the nominal interior diameter to the nominal wall is 35 or less, the difference between the maximum and minimum diameters shall not normally exceed 8% of the average measured outside diameter of the straight portion of the pipe. Where special operating conditions or code provisions require an ovality less than 8% it may be necessary to use larger radii or heavier pipe walls to achieve such requirements."

BRIEF STATEMENT OF THE INVENTION

It is an object of the invention to provide an improved pipe-bending die and technique, enabling the indicated standard to be more readily achieved.

Another object is to provide a die and technique of the character indicated, permitting shorter-radius bends to be made, with substantially less ovality, than indicated by said standard.

It is a specific object to meet the above objects for pipe bends having as short a bend radius as three nominal pipe diameters.

Another specific object is to meet the above objects with bends having section ovality much less than five percent in excess of the average measured outside diameter of the straight portion of the involved pipe.

The foregoing objects and other features of the invention are achieved through employment of what I term a split-die configuration wherein die contact with the bending pipe is localized to essentially two developing lines of tangential contact, respectively at equal and opposite offsets from the central radial plane in which the bend is developed about the axis of the bending arc. More specifically, the die configuration is such that at no time is the pipe permitted to derive direct die-contacting support in or near this central radial plane.

DETAILED DESCRIPTION

The invention will be described in detail, in illustrative application to the bending of hot steel pipe, in conjunction with the accompanying drawings, in which.

Figure 1:
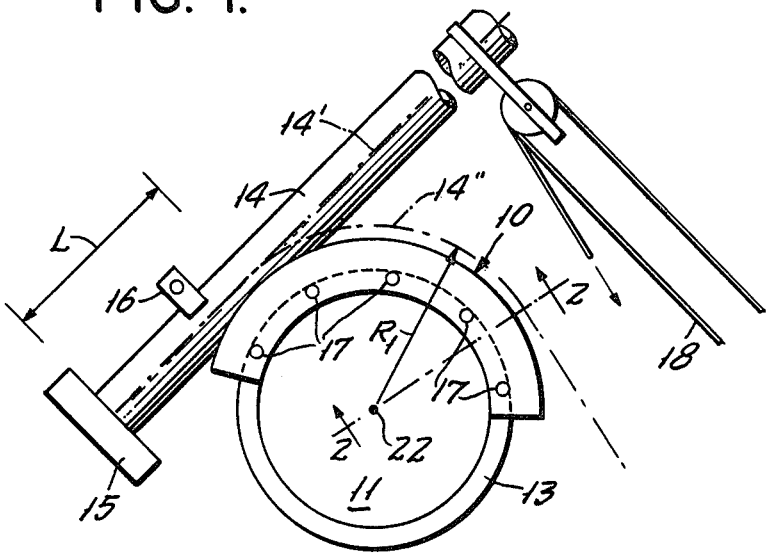
FIG. 1 is a simplified fragmentary plan view, showing a straight length of pipe ready for bending with apparatus of the invention.
Figure 2:
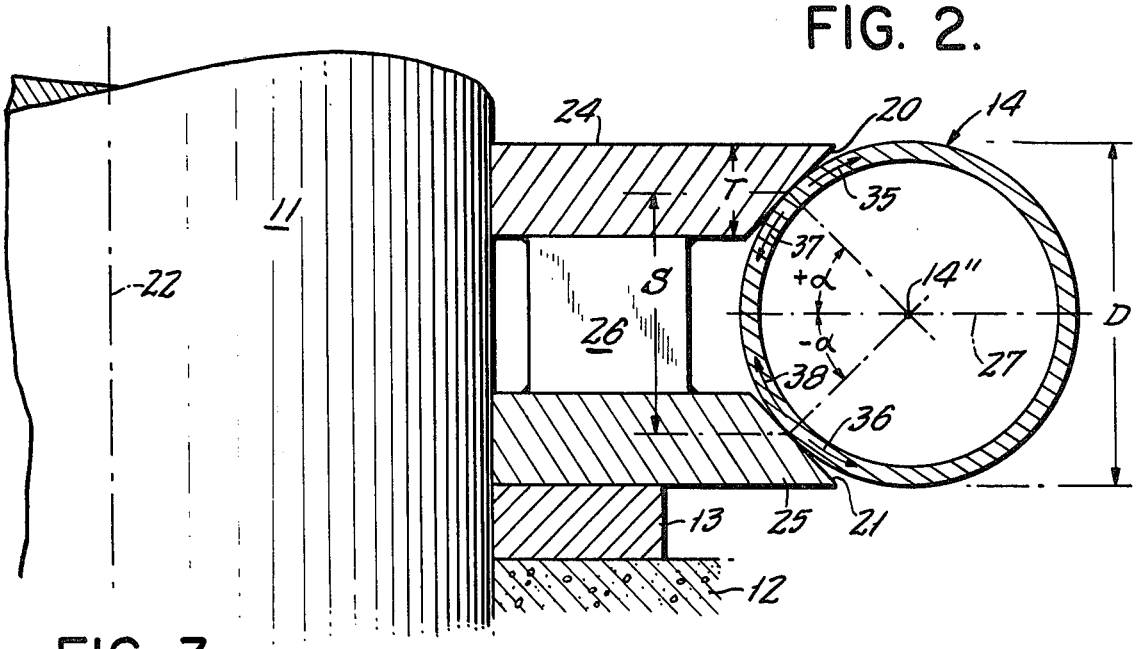
FIG. 2 is an enlarged vertical sectional view taken at 2—2 of FIG. 1, as of the time when the bend of the pipe has traversed the section plane.

In the form of FIGS. 1 and 2, an arcuate die 10 is mounted to a rugged vertical post 11, the base end of which is permanently embedded in a concrete-floor foundation 12 and the upper end of which projects above the horizontal plane of the floor. A spacer 13 supports die 10 at desired offset from the floor plane. Pipe 14 to be bent according to the arc of die 10 is mounted for tangent contact with the die, in such manner as to establish a predetermined length L of a tangent straight end of the pipe; as shown, a stop 15 determines the tangent length L and a clamp 16 secures the tangent mounting. Bolts 17 fixedly secure die 10, as to the spacer 13. Bending occurs upon application of force to the free end of the pipe 14, as by block and tackle 18 with winch drive (not shown). The central axis 14' of the pipe is thus caused to assume a bend, to the die-conforming curve 14'', of arcuate extent as may be prescribed for a particular job.

In accordance with a feature of the invention, the die 10 is structured to provide two opposed and divergent generally frusto-conical surfaces 20–21 having tangential contact with the outer wall surface of pipe 14. The surface 20 is arcuate and frusto-conical about the central axis of the die, namely, the central axis 22 of the upstanding post 11. Surface 20 is shown formed as the convex outer edge of the upper one (24) of two spaced parallel base-plate members, and the surface 21 is similarly formed on the other base-plate member 25. The spacing is rigidly maintained by spacer means 26, shown with welded connection to members 24–25. The thickness T of members 24–25 is selected for rigid maintenance of the slope of surfaces 20–21 and of their spacing, and it will be understood that a given die 10, thus constituted, may serve to provide tangential support of pipe 14 of diameter which is within a range of departure from the external diameter D of pipe 14.

As shown, pipe 14 has such tangential contacts within the vertically central region of the respective surfaces 20–21, the angular spread between such contacts being substantially at equal and opposite offsets ($\pm\alpha$) with respect to the central radial plane 27 in which the bent pipe axis 14'' develops about the vertical axis 22; I currently believe that the $\pm\alpha$ range should be between 75 and 150 degrees, being preferably 80 to 110 degrees. Importantly, die 10 is physically clear of contact with pipe 14 in the substantial axial space on both sides of the central plane 27 of the bend.

Figure 3:
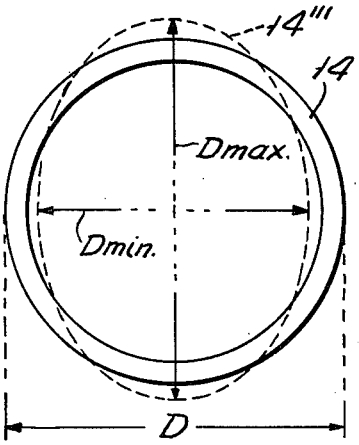
FIG. 3 is a simplified diagram to facilitate a discussion of ovality in pipe bending.

In an illustrative specific use of the described apparatus, a 20-ft. length of 0.5-inch thick, 10-inch nominal outside diameter steel pipe 14 was tightly packed with sand and heat-soaked at a temperature in the range of 2000° F., to reduce yield strength of the pipe material. It was then applied with 30-inch tangent length L to a die 10 designed to produce a "five diameter" bend axis 14'', meaning that the radius $R_1$ of the arc of bend axis 14'' was 50 inches, being five times the pipe diameter. Bending moment was applied via means 18 until accomplishment of a desired 90-degree arc about the central axis 22. After cooling, the thus-fabricated pipe 14 was carefully inspected for ovality and other signs of distortion attributable to bending. There were no visible signs of corrugation or ovality, the only mark being an inconspicuous narrow and short "flat" (actually frusto-conical) at each of the regions of developing tangential contact with surfaces 20–21. The bent specimen was carefully measured and found to have an ovality less than 1.5%, meaning (in reference to FIG. 3) a maximum major axis extent $D_{max}$ (of a resulting ellipse 14''') which exceeded the nominal diameter D by less than 0.15 inch. The result was found to be repeatedly obtainable, with successive pipe lengths 14 of the same size.

In another illustrative specific use, a similar length of 10-inch diameter steel pipe, 1-inch thick, was applied to a die as in FIG. 2, but configured for a three-diameter bend, meaning that the radius $R_1$ for bend axis 14'' was 30 inches. Heat-soaking and tangent clamping were as above-described. The ovality of the bent product was examined and found to be within 6%, while wall-thinning attributable to bending was 11% of the original pipe-wall thickness; this compares most favorably with 20% tolerable thinning limitation set forth in PFI Standard ES-24, for a three-diameter bend.

Figure 4:
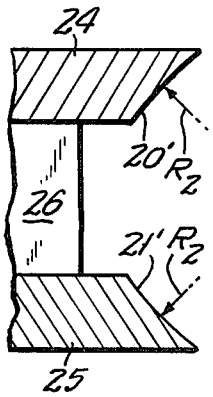
FIG. 4 is a fragmentary vertical sectional view of die elements modified with respect to the form of FIG. 2.

FIG. 4 illustrates a modified die 10' wherein the surfaces 20'–21' for die contact with pipe are characterized by concave curvature, as viewed in a vertical section plane. The curvature shown is to a radius $R_2$ which is preferably slightly in excess of the nominal pipe-section radius D/2, thereby assuring a wider distribution of tangential-contact load, at surfaces 20'–21', namely a wider distribution than for the first-described case of pipe-bending against frusto-conical surfaces 20–21 (FIG. 2).

Figure 5:
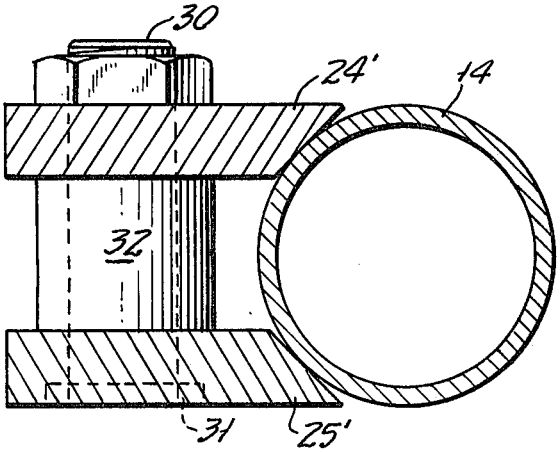
FIG. 5 is a vertical sectional view to illustrate a further modification.

FIG. 5 shows a further die modification, wherein the upper and lower base-plate members 24'–25' are adjustably spaced apart. As shown, bolt means 30 extends through aligned openings in members 24'–25' and has an enlarged lower head 31, set in a counterbore in the underside of the lower base-plate member 25'. Bolt means 30 will be understood to be one of a plurality, in angularly spaced distribution about axis 22, axial spacing being determined by length selection of spacer-sleeve means 32, for each bolt 30. Choice of axial length for spacer means 32 determines the size of pipe 14 that may be accommodated by the die structure of FIG. 5, as will be understood.

I have not thus far established a complete explanation as to why my split-die bending technique is able to produce a superior finished product, to smaller bend radii than hitherto deemed possible. However, my present thinking is that, with the indicated prior apparatus, the initiation and continuing progress of a given bend necessarily involve major abutment reaction at the central plane 27 of the bend. All forces to produce the bend focus in the vicinity of this plane, and on the radially inner limit of the bend. And, to the extent that the vertical-section radius of curvature of the die exceeds the local outer-wall radius of the pipe, there is no way to avoid ovalizing. On the other hand, with my split-die configuration, the absence of die contact at the region where pipe-bending forces had previously been focused, coupled with the division of load necessarily accomplished via two spaced regions of tengential contact, means (a) that ovalizing forces must have been reduced by at least a factor of two and (b) that in the region between tangential contacts the originally circular arc of pipe curvature can remain undisturbed by any local force, even for the slight bodily displacement (radially inward with respect to axis 22) which might be attributable to the above-noted narrow local "flat" indentations, by reason of pipe engagement to surfaces 20–21. It is further reasoned that for the approximately 45-degree angle of frusto-conical slope shown for surfaces 20–21 (with respect to the central radial plane 27), bend-reaction forces become translated into circumferential forces in the pipe section, such tangential forces dividing symmetrically in opposite circumferential directions from each of the developing lines of tangential contact. Such division of distributed force reaction is suggested in FIG. 2 by circumferentially outward arrows 35(36) and by circumferentially inward arrows 37(38) for the respective die-contact surfaces 20(21). Having thus circumferentially divided and distributed the reaction forces, there remains little or no force concentration to create an ovalizing condition, and I find that even shorter-radius bends may be created, to close ovalizing tolerances, for a given pipe size and thickness.

The described invention will be seen to achieve all stated objects, enabling the pipe fabricator to produce bends of superior quality and appearance. And the principles of the invention will be seen to be applicable to hot or cold bending of a wide variety of pipe materials and dimensions, including application to pipe sections other than circular, as for example pipe of oval section. It is also to be noted that in situations in which the pipe material is of hardness equal to or greater than that of the die surfaces 20–21 the die surfaces are or may be relatively yieldable and therefore less likely to leave any "flats" in the bent product.

Quite aside from the foregoing, the invention will be seen to provide, for any given split die, an adaptability to a range of variation in the outside diameter of pipe to be bent. This adaptability follows from the fact that the substantially frustoconical surfaces 20–21 (20'–21') of the die are needed only for their essentially tangential contact with the pipe 14, and depending upon the thickness of plates 24–25,the surfaces 20–21 (20'–21') will determine a range of the span S between spaced parallel lines of tangential contact with the pipe. Stated in other words, the pipe diameter D may be larger or smaller than that suggested by the drawings, as long as the substantially tangential contact lines are developed along the respective die elements 20–21 (20'–21').

Still further, since the span S between spaced lines of tangential contact may vary, depending upon pipe size, it follows that for any given die set 24–25, the profile 14'' of the bend axis may be of radius $R_1$ which is a function of the diameter of the pipe being bent. And of course, by selecting the spacing between plates of a die set as described for FIG. 5, it follows that pipe 14 of a given diameter D may be bent to different radii $R_1$ by proper choice of the spacing between die elements 24'–25'.

While the invention has been described in detail for preferred embodiments, it will be understood that modifications may be made without departing from the scope of the claims.

What is claimed is:

1. Forming-die structure for use in the arcuate bending of a length of pipe of given range of outer diameters, such bending being in a radial plane about the bending axis, said structure comprising two axially spaced parallel base-plate members and means rigidly retaining their spaced relation on opposite sides of the radial plane of the bend, the outer-edge profile of said members being arcuate to the same radius about the bend axis, each of said edges being conical about the bend axis, the respective slopes of the generally conical edges being convergent in the axial direction of said radial plane, the axial extent of each of said conical edges and the axial spacing of said members being such in relation to the given pipe diameter as to enable concurrent local tangential pipe-section contact with the generally conical edges of both members, said members being free of such pipe-section contact on both axial sides of each such contact, whereby in the course of making a bend against the conical surfaces of said members, the material of the pipe engages the die structure only at opposite axial offsets from the radial plane of the bend, and whereby the range of pipe diameters upon which said forming die may be used is substantially determined by the conical extent of said edges.

2. Forming-die structure for use in the arcuate bending of a length of pipe of given outer diameter, such bending being in a radial plane about the bending axis, said structure comprising two axially spaced parallel base-plate members and means rigidly retaining their spaced relation on opposite sides of the radial plane of the bend, the outer-edge profile of said members being arcuate to the same radius about the bend axis, each of said edges being generally conical about the bend axis, the respective slopes of the generally conical edges being convergent in the axial direction of said radial plane, the axial extent of each of said generally conical edges and the axial spacing of said members being such in relation to the given pipe diameter as to enable concurrent local tangential pipe-section contact with the generally conical edges of both members, said members being free of such pipe-section contact on both axial sides of each such contact, whereby in the course of making a bend against the generally conical surfaces of said members, the material of the pipe engages the die structure only at opposite axial offsets from the radial plane of the bend, said rigidly retaining means being removably securable to establish a selected rigidly spaced relation between said base-plate members.

3. Die structure according to claim 1, in which the spacing between base-plate members and the angles of conical convergence are such that, for the given pipe diameter and in section planes which include the bend axis, the axially spaced points of tangential die-to-pipe contact are angularly spaced from each other in the range of 75 to 150 degrees about the center of the pipe section.

4. Die structure according to claim 3, in which said range is 80 to 110 degrees.

5. Die structure according to claim 1, in which said generally conical edges are to a degree naturally yieldable in response to local pipe section contact.

6. Die structure according to claim 1, in which said base-plate members have inner-edge profiles conforming to the same cylindrical radius and concentric with the outer-edge profiles.

7. Forming-die structure for use in the arcuate bending of a length of pipe of a given range of outer diameters, such bending being in a radial plane about the bending axis, said structure having an outer-edge profile which is arcuate about the bend axis, said edge profile being characterized by two axially spaced pipe-engageable bending-force reaction surfaces which are conical about the bending axis and which diverge in the direction away from the bending axis, the axial extent of each of said conical surfaces and the axial spacing therebetween being such in relation to the given pipe diameter as to enable concurrent local tangential pipe-section contact with said conical surfaces, said die structure being free of such pipe-section contact on both axial sides of each such contact, whereby in the course of making a bend against said conical surfaces, the material of the pipe engages the die structure only at opposite axial offsets from the radial plane of the bend, and whereby the range of pipe diameters upon which said forming die may be used is substantially determined by the conical extent of said edges.

8. The method of bending a length of straight bendable pipe of uniform section to a curvilinear bent course in a radial plane about a bend axis, which method comprises establishing two axially spaced frusto-conical plates having confinement-surface regions of generally arcuate external contour conforming to said course, said surface regions being conically divergent, selecting pipe of diameter within a range of sizes capable of concurrent tangential contact with both of the divergent frusto-conical confinement-surface regions, clamping a tangent end of the selected pipe to one angular locale of the confinement regions, and so drawing the free end of the pipe into simultaneous and continually advancing contact with both surface regions as to assure circumferentially directed division of bending-force reaction tangentially localized at substantially equal and opposite axial offsets from said radial plane.

9. Forming-die structure for use in the arcuate bending of a length of pipe of a given range of outer diameters, such bending being in a radial plane about the bending axis, said structure having an outer-edge profile which is arcuate about the bend axis, said edge profile being characterized by two axially spaced pipe-engageable bending-force reaction surfaces which are concaved but generally conical about the bending axis and which diverge in the direction away from the bending axis, the axial extent of each of said generally conical surfaces and the axial spacing therebetween being such in relation to the given pipe diameter as to enable concurrent local tangential pipe-section contact with said generally conical surfaces, said die structure being free of such pipe-section contact on both axial sides of each such contact, the radius ($R_2$) of curvature of each of said reaction surfaces being of substantially greater extent than the range of radii of outer pipe diameters that may be accommodated by tangential contact of a given pipe with both said reaction surfaces, whereby in the course of making a bend against said generally conical surfaces, the material of the pipe engages the die structure only at opposite axial offsets from the radial plane of the bend, and whereby the range of pipe diameters upon which said forming die may be used is substantially determined by the generally conical extent of said edges.

* * * * *